US005363818A

United States Patent [19]

Iwata et al.

[11] Patent Number: 5,363,818

[45] Date of Patent: Nov. 15, 1994

[54] VALVE OPERATING APPARATUS IN INTERNAL COMBUSTION ENGINE

[75] Inventors: Takeshi Iwata; Takatoshi Aoki, both of Saitama, Japan

[73] Assignee: Honda Giken Kogyo Kabushiki Kaisha, Tokyo, Japan

[21] Appl. No.: 960,001

[22] PCT Filed: Apr. 12, 1991

[86] PCT No.: PCT/JP91/00484

§ 371 Date: Jan. 13, 1993

§ 102(e) Date: Jan. 13, 1993

[87] PCT Pub. No.: WO91/16527

PCT Pub. Date: Oct. 31, 1991

[30] Foreign Application Priority Data

Apr. 13, 1990 [JP] Japan ..... 2-40026[U]

[51] Int. Cl.[5] ..... F01L 1/04; F01L 1/34

[52] U.S. Cl. ..... 123/90.16; 123/90.23; 123/90.27

[58] Field of Search ..... 123/90.15, 90.16, 90.17, 123/90.22, 90.23, 90.27

[56] References Cited

U.S. PATENT DOCUMENTS

| | | | |
|---|---|---|---|
| 4,690,110 | 9/1987 | Nishimura et al. | 123/90.17 |
| 4,724,802 | 2/1988 | Ishii | 123/90.16 |
| 4,759,321 | 7/1988 | Matsumoto et al. | 123/90.27 |
| 4,765,289 | 8/1988 | Masuda et al. | 123/90.16 |
| 4,768,467 | 9/1988 | Yamada et al. | 123/90.16 |
| 4,854,273 | 8/1989 | Uesugi et al. | 123/90.17 |
| 4,883,027 | 11/1989 | Oikawa et al. | 123/90.16 |
| 5,095,859 | 3/1992 | Iwata et al. | 123/90.16 |

FOREIGN PATENT DOCUMENTS

| | | | |
|---|---|---|---|
| 59-25007 | 2/1984 | Japan . | |
| 62-279214 | 12/1987 | Japan . | |
| 63-57806 | 3/1988 | Japan . | |
| 63-219805 | 9/1988 | Japan . | |
| 242108 | 2/1990 | Japan . | |
| 229906 | 10/1991 | Japan | 123/90.27 |

*Primary Examiner*—E. Rollins Cross
*Assistant Examiner*—Weilun Lo
*Attorney, Agent, or Firm*—Lyon & Lyon

[57] ABSTRACT

In a valve operating apparatus comprising a drive rocker arm which is interposed between a cam shaft and at least an intake valve of intake and exhaust valves spring-biased in closing directions and which is operatively connected to the intake valve, a free rocker arm also interposed between the cam shaft and at least the intake valve and capable of being liberated from said intake valve, a connection switchover mechanism provided in said rocker arms and capable of switching-over the connection and disconnection of said rocker arms, and a lost motion mechanism provided in an engine body for resiliently biasing said free rocker arm toward the cam shaft, wherein said lost motion mechanism (38) is disposed in a support member (37) disposed above the cylinder head (2), and the free rocker arm (26) is disposed below the support member (37). This makes it possible to insure a sufficient space below the rocker arms (24 to 26).

3 Claims, 3 Drawing Sheets

VALVE OPERATING APPARATUS IN INTERNAL COMBUSTION ENGINE

TECHNICAL FIELD

The present invention relates to a valve operating apparatus comprising a drive rocker arm which is interposed between a cam shaft and at least an intake valve of intake and exhaust valves disposed in a cylinder head of an engine body and spring-biased in closing directions and which is operatively connected to the intake valve, a free rocker arm also interposed between the cam shaft and at least the intake valve and capable of being liberated from the intake valve, a connection switchover mechanism provided in the rocker arms and capable of switching-over the connection and disconnection of the rocker arms, and a lost motion mechanism provided in the engine body for resiliently biasing the free rocker arm toward the cam shaft.

TECHNICAL SUBJECT

Such a valve operating apparatus is conventionally known, for example, from the publication of Japanese Patent Application Laid-open No. 57806/88.

In the above prior art valve operating apparatus, the lost motion mechanism is provided in the cylinder head to resiliently bias the free rocker arm upwardly from a side of the cylinder head. Moreover, disposed in an upper portion of the cylinder head are intake and exhaust ports, cylindrical guides for guidance of intake and exhaust valves, valve springs for biasing the intake and exhaust valves and the like. To insure a space in which the lost motion mechanism is disposed, the variations in design such as the shape of the ports, of the valve springs and the like are reduced, and it is difficult to reduce the cylinder head in size.

SUMMARY OF THE INVENTION

The present invention has been accomplished with the above circumstances in view, and it is an object of the present invention to provide a valve operating apparatus in an internal combustion engine, wherein the variations in design of the upper portion of the cylinder head is increased, and the cylinder head can be reduced in size.

To achieve the above object, according to the present invention, the lost motion mechanism is disposed in a support member disposed above the cylinder head, and the free rocker arm is disposed below the support member.

With such construction, it is possible to insure a space below the rocker arms, which is enough to dispose the intake and exhaust ports, the cylindrical guides for guidance of the intake and exhaust valves, the valve springs for biasing the intake and exhaust valves in closing directions and the like. This makes it possible to increase the variations in design and to reduce, in size, the upper portion of the engine body.

Further, the lost motion mechanism can be disposed without being interfered by the intake and exhaust ports and the like and therefore, the lost motion mechanism can be disposed at a location where its resilient force can be exhibited in a most effective manner. Moreover, the lost motion mechanism can be reduced in size.

BRIEF DESCRIPTION OF THE DRAWINGS

Drawings illustrate one embodiment of the present invention, wherein.

BEST MODE FOR CARRYING OUT THE INVENTION

One embodiment of the present invention will now be described in connection with the accompanying drawings.

Figure 1:
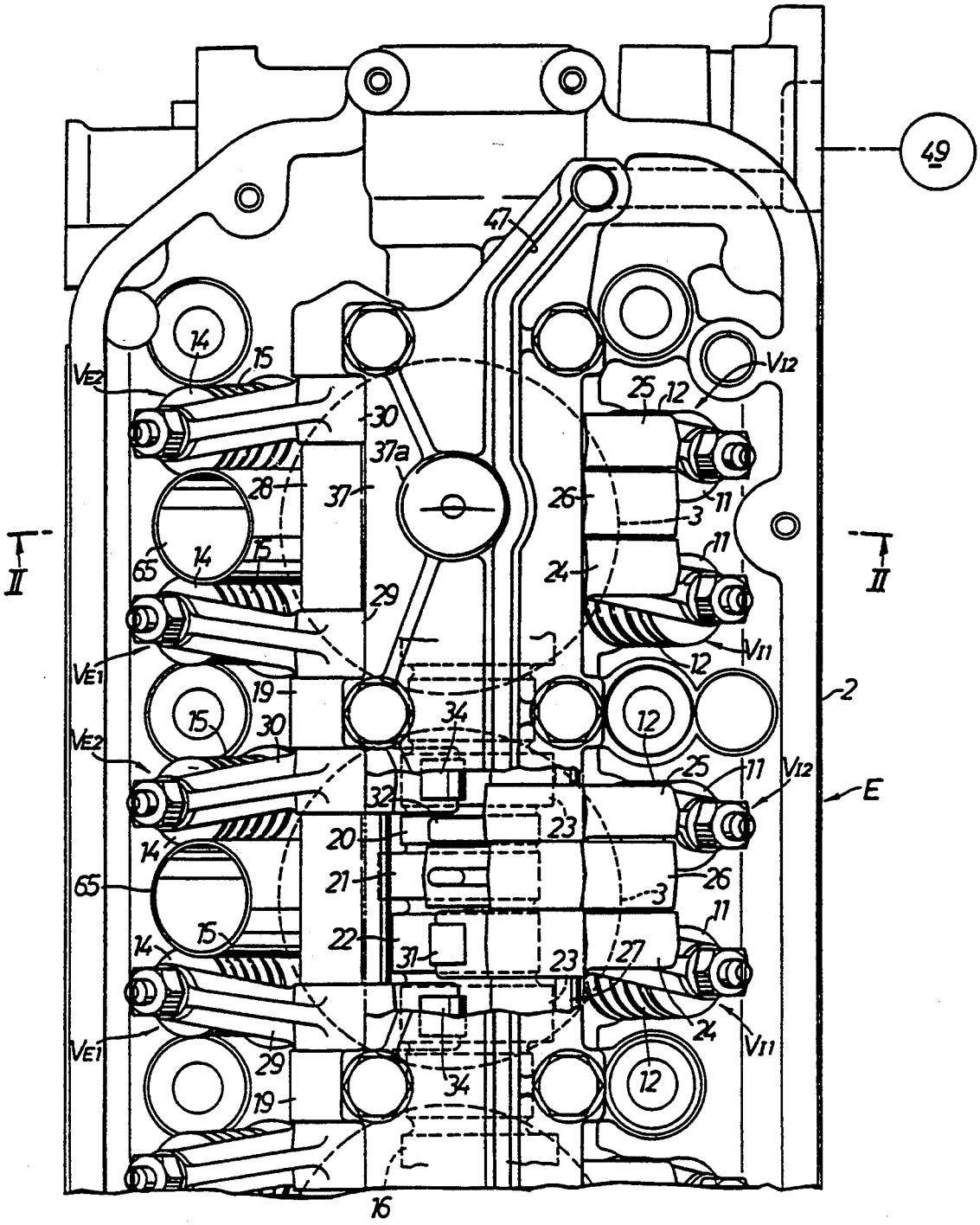
FIG. 1 is a plan view of an essential portion.
Figure 2:
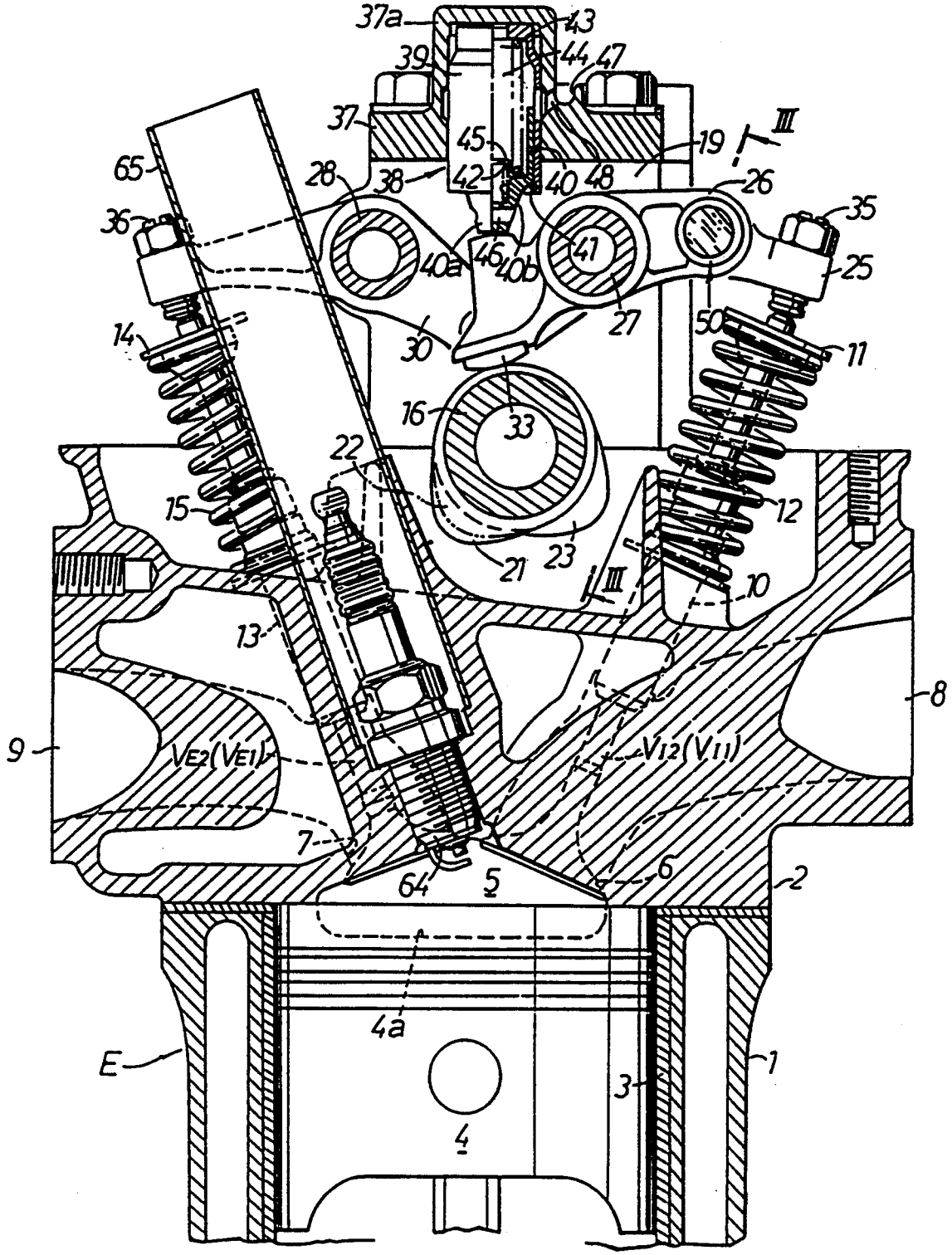
FIG. 2 is a sectional view taken along a line II—II in FIG. 1.

Referring first to FIGS. 1 and 2, an essential portion of an engine body E in an SOHC type multi-cylinder internal combustion engine is comprised of a cylinder block 1 and a cylinder head 2 coupled to an upper surface of the cylinder block 1. A piston 4 is provided in an upper surface thereof with a depression 4*a*, and is slidably received in each of a plurality of cylinders 3 which are provided in the cylinder block 1 at a distance from one another in an axial direction of a crankshaft which is not shown. A combustion chamber 5 is defined between the upper surface of the piston 4 and the cylinder head 2.

A pair of intake valve bores 6 and a pair of exhaust valve bores 7 are provided in the cylinder head 2 in correspondence to the cylinders 3 and are opened into a ceiling surface of the combustion chamber 5. Both the intake valve bores 6 are connected to a single intake port 8 which is opened into one side of the cylinder head 2, and both the exhaust valve bores 7 are connected to a single exhaust port 9 which is opened into the other side of the cylinder head 2. A pair of intake valves $V_{I1}$ and $V_{I2}$ capable of independently opening and closing each of the intake valve bores 6 are slidably received in a pair of cylindrical guides 10 which are disposed in the cylinder head 2. Coiled valve springs 12, 12 are interposed between the cylinder head 2 and retainers 11, 11 fixed to the upper ends of the intake valves $V_{I1}$ and $V_{I2}$ which project from the corresponding cylindrical guides 10, so as to surround the intake valves $V_{I1}$ and $V_{I2}$, respectively. The intake valves $V_{I1}$ and $V_{I2}$ are biased upwardly, i.e., in their closing directions by means of the valve springs 12, 12, respectively. A pair of exhaust valves $V_{E1}$ and $V_{E2}$ capable of independently opening and closing the exhaust valve bores 7 are slidably received in a pair of cylindrical guides 13 which are disposed in the cylinder head 2. And coiled valve springs 15, 15 are interposed between the cylinder head 2 and retainers 14, 14 fixed to the upper ends of the exhaust valves $V_{E1}$ and $V_{E2}$ which project from the corresponding cylindrical guides 13, so as to surround the exhaust valves $V_{E1}$ and $V_{E2}$, respectively. The exhaust valves $V_{E1}$ and $V_{E2}$ are biased upwardly, i.e., in their closing directions by means of the valve springs 15, 15, respectively.

A first 24 and a second drive rocker arm 25 and a free rocker arm 26 are interposed between the intake valves $V_{I1}$ and $V_{I2}$ and a single cam shaft 16 operatively connected to the crankshaft (not shown) at a reduction ratio of $\frac{1}{4}$ so as to convert the rotation of the cam shaft 16 into the opening and closing motions of the intake valves $V_{I1}$ and $V_{I2}$. And a pair of exhaust rocker arms 29 and 30 are interposed between the cam shaft 16 and the exhaust valves $V_{E1}$ and $V_{E2}$ so as to convert the rotation of the cam shaft 16 into the opening and closing motions of the exhaust valves $V_{E1}$ and $V_{E2}$.

Figure 3:
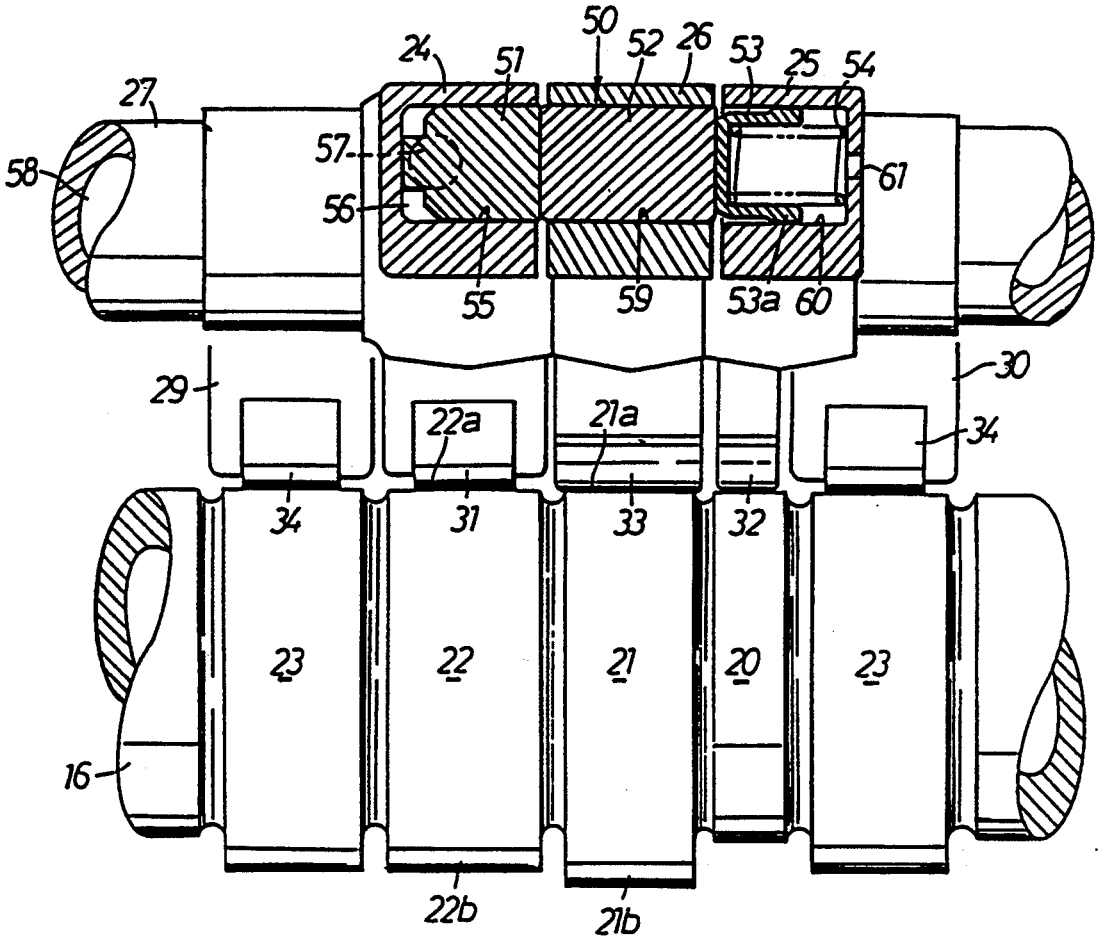
FIG. 3 is a sectional view taken along a line III—III in FIG. 2.

Referring also to FIG. 3, the cam shaft 16 has a horizontal axis perpendicular to an axis of each cylinder 3 and is rotatably supported by the cylinder head 2 and holders 19, 19 coupled onto the cylinder head 2 on opposite sides of each cylinder 3 along an axis of the crankshaft. The cam shaft 16 is integrally provided with a high speed cam 21, a low speed cam 22 adjoining one side of the high speed cam 21, and a raised portion 20 adjoining the high speed cam 21 on the opposite side from the low speed cam 22. The cam shaft 16 is also provided integrally with exhaust valve cams 23, 23 on outer opposite sides of the low speed cam 22, high speed cam 21 and the raised portion 20. The high speed cam 21 has a shape suitable for opening and closing the intake valves $V_{I1}$ and $V_{I2}$ in a high speed operation region of the engine and includes a base circle portion 21*a* and a lobe portion 21*b* protruding radially outwardly from the base circle portion 21*a*. The low speed cam 22 has a shape suitable for opening and closing the intake valve $V_{I1}$ in a lower speed operation region of the engine and includes a base circle portion 22*a* and a lobe portion 22*b*. This lobe portion 22*b* protrudes from the base circle portion 22*a* radially outwardly of the cam shaft 16 in an amount smaller than that of the lobe portion 21*b* of the high speed cam 21 and over a scope of a central angle smaller than that of the lobe portion 21*b*. The raised portion 20 is basically formed to have an outer surface which is circular about the axis of the cam shaft 16, so that the intake valve $V_{I2}$ is brought into a substantially inoperative state in the lower speed operation region of the engine. But a slightly protruding projection is provided on the raised portion 20 at a location corresponding to each of the lobe portions 21*b* and 22*b* of the higher and low speed cams 21 and 22. Moreover, the width of the raised portion 20 in a direction along the axis of the cam shaft 16 is set at a relatively small value. Further, each of the exhaust valve cams 23, 23 has a shape suitable to open and close the exhaust valves $V_{E1}$ and $V_{E2}$ regardless of the operational condition of the engine.

The first drive rocker arm 24 is operatively connected to one intake valve $V_{I1}$, and the second drive rocker arm 25 is operatively connected to the other intake valves $V_{I2}$. The free rocker arm 26 is disposed adjacently between the first and second rocker arms 24 and 25, so that it can be liberated from the intake valves $V_{I1}$ and $V_{I2}$. Intermediate portions of the rocker arms 24, 25 and 26 are swingably carried on an intake rocker arm shaft 27 which is fixedly supported on the holders 19, 19—above the cam shaft 16 and has an axis parallel to the cam shaft 16. The pair of exhaust rocker arms 29 and 30 are independently operatively connected to the exhaust valves $V_{E1}$ and $V_{E2}$, respectively. Intermediate portions of the exhaust rocker arms 29 and 30 are swingably carried on an exhaust rocker arm shaft 28 which is fixedly supported on the holders 19, 19—in parallel to the intake rocker arm shaft 27 above the cam shaft 16.

A roller 31 is carried at one end of the first drive rocker arm 24 which comes into sliding contact with the low speed cam 22 provided on the cam shaft 16. And a slipper 32 which comes into sliding contact with the raised portion 20 provided on the cam shaft 16 is provided at one end of the second drive rocker arm 25. A width of the slipper 32 is made small so as to correspond to the raised portion 20. Provided on the free rocker arm 26 is a cam slipper 33 which comes into sliding contact with the high speed cam 21 provided on the cam shaft 16. In addition, a roller 34 which comes into sliding contact with each of the exhaust valve cams 23, 23 provided on the cam shaft 16 is carried at one end of each of the exhaust rocker arms 29 and 30.

A tappet screw 35 is advanceably and retreatably screwed into the other end of each of the first and second drive rocker arms 24 and 25 to abut against an upper end of each of the intake valves $V_{I1}$ and $V_{I2}$. The intake valves $V_{I1}$ and $V_{I2}$ are opened and closed in accordance with the swinging movements of the intake rocker arms 24 and 25. A tappet screw 36 is also advanceably and retreatably screwed into the other end of each of the rocker arms 29 and 30 to abut against an upper end of each of the exhaust valves $V_{E1}$ and $V_{E2}$. The exhaust valves $V_{E1}$ and $V_{E2}$ are opened and closed in accordance with the swinging movements of the exhaust rocker arms 29 and 30.

A support plate 37 as a support member is fixed to upper ends of the holders 19, 19—which extend upwardly from the cylinder head 2 on opposite sides of the respective cylinder 3, so as to connect the holders 19, 19—. And a lost motion mechanism 38 is provided in the support plate 37 for resiliently biasing the free rocker arm 26 from the above toward the high speed cam 21.

The lost motion mechanism 38 comprises a bottomed cylindrical guide member 39 fitted in the support plate 37, a piston 40 slidably received in the guide member 39 and provided with a tapered abutment portion 41*a* at an end of the piston 40 closer to the free rocker arm 26 to abut against the free rocker arm 26, a stopper 41 releasably secured to an inner surface of the guide member 39 closer to its opened end to engage the piston 40, and a first 42 and a second spring 43 interposed between the piston 40 and the guide member 39 for resiliently biasing the piston 40 in a direction to abut against the free rocker arm 26.

The support plate 37 includes a bottomed cylindrical portion 37*a* whose upper end is closed but a lower end thereof is opened at a location corresponding to each of the free rocker arms 26. The guide member 39 is fitted in the bottomed cylindrical portion 37*a* with an opened end of the member 39 directed dowardly. A spring chamber 44 is defined between the piston 40 and the guide member 39. The first spring 42 having a relatively small spring constant is compressed between the piston 40 and a retainer 45 contained in the spring chamber 44. And the second spring 43 having a relatively large spring constant is compressed between the retainer 45 and a closed end of the guide member 39.

A small diameter hole 40*b* having a closed bottom is concentrically provided in an inner surface of the closed end of the piston 40. And the first spring 42 having the relatively smaller spring constant is contained in the small diameter hole 40*b* and thereby prevented from becoming inclined. In order to prevent the inside of the spring chamber 44 from being pressurized and depressurized during a sliding operation of the piston 40, a cross-shaped air vent hole 46 is provided in the abutment portion 40*a* of the piston 40 and is opened into an outer surface of the abutment 40*a*, for permitting the communication of the spring chamber 44 with the outside.

Further, provided on the support plate 37 is an oil groove 47 which extends in parallel to the cam shaft 16 adjacent a base end of the bottomed cylindrical portion 37*a*. An oil passage 48 is provided in the base end of the bottomed cylindrical portion 37a and the guide member 39 for permitting oil flowing through the oil groove 47 to be passed into the spring chamber 44. Thus, by passing a lubricating oil supplied from a lubricating oil supply pump 49 through the oil groove 47, the lubricating oil can be supplied to between the piston 40 and the guide member 39.

A connection switchover mechanism 50 is provided in the first drive rocker arm 24, the second drive rocker arm 25 and the free rocker arm 26 and capable of switching-over the connection and disconnection of these rocker arms 24 to 26.

The connection switchover mechanism 50 comprises a connecting piston 51 capable of connecting the first drive rocker arm 24 and the free rocker arm 26 to each other, a connecting pin 52 capable of connecting the free rocker arm 26 and the second drive rocker arm 25 to each other, and a restraining member 53 for restraining the movements of the connecting piston 51 and the connecting pin 52, and a return spring 54 for biasing the connecting piston 51, the connecting pin 52 and the restraining member 53 in a disconnecting direction.

A first blind guide bore 55 is provided in the first drive rocker arm 24 in parallel to the intake rocker arm shaft 27 and opened to the free rocker arm 26 side. The connecting piston 51 is slidably received in the first guide bore 55. A hydraulic pressure chamber 56 is defined between one end of the connecting piston 51 and a closed end of the first guide bore 55. A communication passage 57 is also provided in the first drive rocker arm 24 to communicate with the hydraulic pressure chamber 56. A hydraulic pressure supply passage 58 is provided in the intake rocker arm shaft 27 and leads to a hydraulic pressure supply source which is not shown. The hydraulic pressure supply passage 58 always communicates with the communication passage 57 irrespective of the swinging condition of the drive rocker arm 24.

A guide bore 59 corresponding to the first guide bore 55 is provided in the free rocker arm 26 in parallel to the intake rocker arm shaft 27 to extend between opposite sides of the free rocker arm 26. And the connecting pin 52 having one end abutting against the other end of the connecting piston 51 is slidably received in the first guide bore 59.

A second blind guide bore 60 corresponding to the guide bore 59 is provided in the second drive rocker arm 25 in parallel to the intake rocker arm shaft 27 and opened to the free rocker arm side 26. And the bottomed cylindrical restraining member 53 abutting against the other end of the connecting pin 52 is slidably received in the second guide bore 60. The restraining member 53 is disposed with its opened end directed to a closed end of the second guide bore 60, and a collar 53a projecting radially outwardly at an opened end of the restraining member 53 is in slide contact with an inner surface of the second guide bore 60. The return spring 54 is compressed between the closed end of the second guide bore 60 and the closed end of the restraining member 53. The connecting piston 51, the connecting pin 52 and the restraining member 53 abutting against one another are biased toward the hydraulic pressure chamber 56 by a spring force of the return spring 54. Moreover, the closed end of the second guide bore 60 is provided with a communication hole 61 for venting air and oil.

Referring again to FIGS. 1 and 2, a spark plug 64 is disposed at a central portion of the ceiling surface of the combustion chamber 5. And a plug pipe 65, into which the spark plug 64 is inserted, is disposed in the cylinder head 2. The pair of exhaust rocker arms 29 and 30 are disposed so as to come into sliding contact with the exhaust valve cams 23, 23, on the opposite sides of the first drive rocker arms 24, the free rocker arm 26 and the second drive rocker arm 25 which are disposed adjacent one another. This makes it possible to insure a relatively wide space between the exhaust rocker arms 29 and 30 and to dispose the exhaust valves $V_{E1}$ and $V_{E2}$ at a relatively wide distance from each other. Therefore, the plug pipe 65 is disposed in the cylinder head 2 so that it is located between the exhaust valves $V_{E1}$ and $V_{E2}$ as well as between the exhaust valve rocker arms 29 and 30. The spark plug 64 inserted into the plug pipe 65 is screwed in the cylinder head 2 to face the central portion of the ceiling surface of the combustion chamber 5.

The operation of this embodiment will be described below.

During a low speed operation of the engine, the hydraulic pressure within the hydraulic pressure chamber 56 in the connection switchover mechanism 50 is released, and the abutment surfaces of the connecting piston 51 and the connecting pin 52 are in a position corresponding to a position between the first drive rocker arm 24 and the free rocker arm 26, while the abutment surfaces of the connecting pin 52 and the restraining member 53 is a position corresponding to a position between the free rocker arm 26 and the second drive rocker arm 25. Therefore, the rocker arms 24, 25 and 26 can be angularly displaced relative to one another.

In such disconnected condition, the rotation of the cam shaft 16 causes the first drive rocker arm 24 to be swung in response to sliding contact with the low speed cam 22, and the one intake valve $V_{I1}$ is opened and closed at a timing and a lift amount depending upon the shape of the low speed cam 22. In addition, the second drive rocker arm 25 in sliding contact with the raised portion 20 is brought into its substantially inoperative state, so that the other intake valve $V_{I2}$ can be brought into its substantially inoperative state. In such a disconnected condition, the intake valve $V_{I2}$ does not become completely inoperative, but is slightly operated in an opening direction when the one intake valve $V_{I1}$ is opened. Thus, it is possible to prevent a sticking of the intake valve $V_{I2}$ to a valve seat which may happen if a completely closed state is maintained. Further, the free rocker arm 26 is swung in response to sliding contact with the high speed cam 21, but such swinging motion does not exert any influence to the first and second drive rocker arms 24 and 25. The exhaust valves $V_{E1}$ and $V_{E2}$ are also opened and closed at a timing and an amount depending upon the shape of the exhaust valve cams 23, 23.

The first drive rocker arm 24, which is in operation in a lower speed region in which a friction loss component in a valve operating system amounts to a large percent of a friction loss in the entire engine, is in sliding contact with the low speed cam 22 through the roller 31, and hence, it is possible to contribute to a reduction in friction loss component in the valve operating system, i.e., a reduction in friction loss in the entire engine in the lower speed region. Moreover, the exhaust rocker arms 29 and 30 are also in sliding contact with the exhaust valve cams 23, 23 through the roller 34, 34 and therefore, it is possible to further reduce the friction loss in the lower speed region.

During a high speed operation of the engine, a higher hydraulic pressure is supplied to the hydraulic pressure chamber 56. This causes the connecting piston 51 in the connection switchover mechanism 50 to be moved in a direction to increase the volume of the hydraulic pressure chamber 56 against the spring force of the return spring 54, while urging the connecting pin 52. When the axes of the first guide bore 45, the guide bore 56 and the second guide bore 57 are aligned with one another, i.e., when the rocker arms 24 to 26 exhibit no relative movement, the connecting piston 51 is received into the guide bore 56 and in response thereto, the connecting pin 52 is received into the second guide bore 57, thereby bringing the rocker arms 24 to 26 into their connected states.

When the rocker arms 24 to 26 are connected in this manner, the free rocker arm 26 in sliding contact with the high speed cam 21 is swung in a largest amount. Therefore, the first and second drive rocker arms 24 and 25 are swung together with the free rocker arm 26, so that the intake valves $V_{I1}$ and $V_{I2}$ are opened and closed at a timing and a lift amount depending upon the shape of the high speed cam 21. In addition, the exhaust rocker arms 29 and 30 cause the exhaust valves $V_{E1}$ and $V_{E2}$ to be also opened and closed at a timing and lift amount depending upon the shape of the exhaust valve cams 23, 23 as during the lower speed operation.

In such valve operating apparatus, the lost motion mechanism 38 for resiliently biasing the free rocker arm 26 toward the cam shaft 16 is disposed in the support plate 37 connecting the upper ends of the holders 19, 19—, and resiliently biases the free rocker arm 26 from the above toward the cam shaft 16. Thus, it is possible to insure a space below the rocker arms 24 to 26 and above the cylinder head 2, which is enough to dispose the intake port 8, the exhaust port 9, the cylindrical guides 10 and 13 for guidance of the intake valves $V_{I1}$ and $V_{I2}$, the valve springs 12 and 15 for biasing the intake valves $V_{I1}$ and $V_{I2}$ and the exhaust valves $V_{E1}$ and $V_{E2}$ in closing directions and the like. This can increase the variation in design, such as shape of the ports 8 and 9, spring load (outside diameter) of the valve springs 12 and 15 and the like and also can reduce the cylinder head 2 in size.

Further, the lost motion mechanism 38 can be disposed without being interfered by the intake and exhaust ports 8 and 9, the guide cylinder 10 and 13, the valve spring 12 and 15 and the like. Therefore, the lost motion mechanism 38 can be disposed at a location where its resilient force can be exhibited in a most effective manner. Thus, a load of each of the first and second springs 42 and 43 can be set small, which contributes to a reduction of size of the springs and thus, of the lost motion mechanism.

What is claimed is:

1. A valve operating apparatus comprising a drive rocker arm (24, 25) which is interposed between a cam shaft (16) and at least an intake valve ($V_{I1}$, $V_{I2}$) of intake and exhaust valves ($V_{I1}$, $V_{I2}$; $V_{E1}$, $V_{E2}$) disposed in a cylinder head (2) of an engine body (E) and spring-biased in closing directions and which is operatively connected to the intake valve ($V_{I1}$, $V_{I2}$), a free rocker arm (26) also interposed between the cam shaft (16) and at least the intake valve ($V_{I1}$, $V_{I2}$) and capable of being liberated from said intake valve ($V_{I1}$, $V_{I2}$), a connection switchover mechanism (50) provided in said rocker arms (24 to 26) and capable of switching-over the connection and disconnection of said rocker arms (24 to 26), and a lost motion mechanism (38) provided in the engine body (E) for resiliently biasing said free rocker arm (26) toward the cam shaft (16), wherein said lost motion mechanism (38) is disposed in a support member (37) disposed above the cylinder head (2), and said free rocker arm (26) is disposed below the support member (37).

2. A valve operting apparatus according to claim 1, wherein said cam shaft (16) is commonly provided for both the intake valve ($V_{I1}$, $V_{I2}$) and the exhaust valve ($V_{E1}$, $V_{E2}$), a plurality of said drive rocker arms (24, 25) independently operatively connected at their one ends to said respective intake valve ($V_{I1}$ and $V_{I2}$) and the free rocker arm (26) are adjacent one another, and carried on an intake rocker arm shaft (27) at intermediate portions of the drive rocker arms (24, 25) and the free rocker arm (26), and wherein said apparatus further includes an exhaust rocker arm (29, 30) which is operatively connected to said exhaust valve ($V_{E1}$, $V_{E2}$), and is interposed between said exhaust valve ($V_{E1}$, $V_{E2}$) and said cam shaft (16), said exhaust rocker arm (29, 30) being carried at its intermediate portion on an exhaust rocker arm shaft (28).

3. A valve operating apparatus according to claim 2, further including holders (19) standing on the engine body (E) at opposite sides of a cylinder (3) along an axis of a crankshaft for supporting said rocker arm shafts (27 and 28), and wherein said support plate (37) is disposed so as to connect upper ends of said holders (19).

* * * * *